US010427175B2

(12) United States Patent
Nagata et al.

(10) Patent No.: US 10,427,175 B2
(45) Date of Patent: Oct. 1, 2019

(54) SPOUT APPARATUS CAUSING RECIPROCAL OSCILLATIONS

(71) Applicant: TOTO LTD., Kitakyushu-shi, Fukuoka (JP)

(72) Inventors: Katsuya Nagata, Kitakyushu (JP); Kiyotake Ukigai, Kitakyushu (JP)

(73) Assignee: TOTO LTD., Kitakyushu-shi, Fukuoka (JP)

( * ) Notice: Subject to any disclaimer, the term of this patent is extended or adjusted under 35 U.S.C. 154(b) by 16 days.

(21) Appl. No.: 15/271,804

(22) Filed: Sep. 21, 2016

(65) Prior Publication Data

US 2017/0087569 A1 Mar. 30, 2017

(30) Foreign Application Priority Data

Sep. 30, 2015 (JP) ..... 2015-194252

(51) Int. Cl.

| | |
|---|---|
| ***B05B 1/34*** | (2006.01) |
| ***B05B 1/18*** | (2006.01) |
| ***B05B 1/08*** | (2006.01) |
| ***B05B 15/65*** | (2018.01) |
| ***E03C 1/04*** | (2006.01) |

(52) U.S. Cl.

CPC ..... *B05B 1/34* (2013.01); *B05B 1/08* (2013.01); *B05B 1/185* (2013.01); *B05B 15/65* (2018.02); *E03C 1/0409* (2013.01)

(58) Field of Classification Search

CPC .... B05B 1/08; B05B 1/10; B05B 1/18; B05B 1/185; B05B 1/202; B05B 1/34; B05B 1/3415; B05B 15/65; B60S 1/52; F15C 1/22; E03C 1/0409

USPC ..... 239/284.1, 566, 589.1, DIG. 3, 413

See application file for complete search history.

(56) References Cited

U.S. PATENT DOCUMENTS 4,052,002 A * 10/1977 Stouffer ..... A61C 17/0214 137/835
4,151,955 A * 5/1979 Stouffer ..... B05B 1/08 137/835

(Continued)

FOREIGN PATENT DOCUMENTS

EP 1675686 B1 12/2007
JP S58-49300 B2 11/1983

(Continued)

*Primary Examiner* — Cody J Lieuwen
(74) *Attorney, Agent, or Firm* — BakerHostetler

(57) ABSTRACT

The present invention is a spout apparatus (1), including: a shower head main body (2), and an oscillation inducing element (4) for discharging water while allowing it to oscillate reciprocally, wherein the oscillation inducing element includes: a water supply passageway (10*a*), a water collision portion (14) for generating vortexes of alternately mutually opposing circulations; a vortex street passageway (10*b*) for guiding and growing vortexes formed by the water collision portion; a discharge passageway (10*c*) for causing water guided by the vortex street passageway to be discharged; a bypass passageway (6*b*) for allowing water to detour the water collision portion and flow into the vortex street passageway; and a flow volume ratio adjusting member (8), capable of varying the flow volume ratio of water flowing into the vortex street passageway through the water collision portion to water flowing into the vortex street passageway through the bypass passageway.

8 Claims, 8 Drawing Sheets

(56) References Cited

U.S. PATENT DOCUMENTS

| | | | | | |
|---|---|---|---|---|---|
| 4,721,251 | A * | 1/1988 | Kondo | B05B 1/08 | 137/839 |
| 5,035,361 | A * | 7/1991 | Stouffer | B05B 1/08 | 137/811 |
| 5,853,624 | A * | 12/1998 | Raghu | B05B 1/08 | 239/589.1 |
| 7,168,629 | B2 * | 1/2007 | Timmes | A61L 2/22 | 134/166 R |
| 2006/0065765 | A1 * | 3/2006 | Hester | B05B 1/08 | 239/589.1 |
| 2011/0233301 | A1 * | 9/2011 | Gopalan | B05B 1/08 | 239/101 |

FOREIGN PATENT DOCUMENTS

| | | | |
|---|---|---|---|
| JP | 2000-120141 | A | 4/2000 |
| JP | 2004-275985 | A | 10/2004 |
| WO | 2005042169 | A1 | 5/2005 |

* cited by examiner

Prior Art

Prior Art

SPOUT APPARATUS CAUSING RECIPROCAL OSCILLATIONS

TECHNICAL FIELD

The present invention pertains to a spout apparatus, and more particularly to a spout apparatus for discharging hot or cold water from a spouting port while causing it to reciprocally oscillate at a variable amplitude.

BACKGROUND ART

Shower heads in which the direction of hot or cold water spouted from a spouting port changes in an oscillating manner are known. In spout apparatuses such as these shower heads, a nozzle is driven in an oscillating manner by the supply force of supplied water, causing the direction of hot or cold water spouted from a spouting port to change. In this type of spout apparatus, hot or cold water can be jetted from a single spouting port over a wide area, enabling the achievement in a compact constitution of a spout apparatus capable of spouting over a wide range.

At the same time, a warm water flush toilet seat apparatus is presented in Japanese Published Unexamined Patent Application 2000-120141 (Patent Document 1). In this warm water flush toilet seat apparatus, a self-oscillation is induced by a fluidic element nozzle, thus changing the direction in which flush water is jetted. Specifically, in this warm water flush toilet seat apparatus, as shown in FIG. 9, feedback flow paths 104 are provided on both sides of the spray nozzle 102. Each of the feedback flow paths 104 is a loop-shaped flow path communicating with the spray nozzle 102, and a portion of the flush water flowing through the spray nozzle 102 flows in and circulates therein. The spray nozzle 102 is shaped to widen in a tapered form toward a spray port 102*a* having an elliptical cross section.

When flush water is supplied, the flush water sprayed from spray nozzle 102 is drawn by the Coanda effect to the wall surface on one side or the other of the elliptical cross section spray port 102*a* and sprayed so as to follow this wall (state "a" in FIG. 9). When flush water is sprayed along one of the wall surfaces, the flush water also flows into the feedback flowpath 104 on the side on which the flush water is being sprayed, and pressure inside the feedback flowpath 104 rises. Due to the rise in pressure, sprayed flush water is pushed, flush water is drawn to the wall surface on the opposite side and sprayed along the wall surface on the opposite side (FIG. 9, state "a"→"b" →"c"). In addition, when flush water is sprayed along the opposite side wall surface, the pressure now rises in the feedback flowpath 104 on the opposite side, and sprayed flush water is pushed back (FIG. 9, state "c" →"b" →"a"). By repetition of this action, sprayed flush water changes direction in an oscillating manner between states "a" and "c" in FIG. 9.

A pure fluidic element is set forth in Japanese Published Unexamined Patent Application 2004-275985 (Patent Document 2). In this pure fluidic element, a linking duct which traverses the fluid jet nozzle is provided; the operation of this linking duct causes an alternating rise in pressure on the upper and lower sides of the fluid jet nozzle. Due to the Coanda effect, the jet current pushed by this pressure rise becomes a jet current along the top plate of the spray jet nozzle, or along the bottom plate thereof; these states are repeated at a certain cycle, becoming a flow in which the spray direction changes in an oscillating manner.

In addition, an oscillating spray apparatus is set forth in Japanese Published Examined Patent Application S.58-49300 (Patent Document 3). This oscillating spray apparatus has the constitution shown in FIG. 10A-10C, and changes the direction of a spray flow sprayed from an outlet 112 in an oscillating manner, or changes the spouting form, by utilizing Karman vortexes generated inside an anterior chamber 110. First, a fluid which has flowed into the anterior chamber 110 from an intake port 114 collides with an obstacle 116 having a triangular cross section, disposed in an island shape inside the anterior chamber 110. When the fluid collides, Karman vortexes are alternately produced downstream of the obstacle 116 on both sides of the obstacle 116.

Close to the outlet 112, the flow velocity on the side where the Karman vortex is present speeds up, and the flow velocity on the other side slows down. In the example shown in FIG. 10A, Karman vortexes are alternately created on the right and left sides of the obstacle 116, and reach the outlet 112 in sequence, therefore a fast right side flow velocity state and a fast left side flow velocity state alternately appear close to the outlet 112. In the state in which the right side flow velocity is fast, the fast flow velocity fluid collides with the wall surface on the right side of the outlet 112, changing direction, and the fluid sprayed from the outlet 112 as a whole becomes a jet current aimed diagonally left and downward. On the other hand in the high flow velocity state on the left side, high velocity fluid collides with a wall surface 110*b* on the left side of the outlet 112, and a jet flow is sprayed from the outlet 112 diagonally right and downward. The alternating repetition of these states results in a reciprocal oscillation during spraying from the outlet 112. In this apparatus, as shown in FIG. 10B or 10C, replacing the outlet portion parts with other parts (118 or 120) changes the oscillation amplitude and spout formation of water spouted from the outlet.

As described above, a system can be conceived in which the fluidic element set forth in Patent Documents 1 through 3 is applied to a spout apparatus such as a shower head, and hot or cold water is discharged as it is oscillates in a reciprocating motion.

PRIOR ART REFERENCES

Patent Documents

Patent Document 1
JP 2000-120141 A
Patent Document 2
JP 2004-275985 A
Patent Document 3
JP S58-49300 B First, in a spout apparatus for changing the direction of hot or cold water spouted by driving a spray nozzle in an oscillating manner, the nozzle must be driven, leading to the problem of complex structure around the nozzle, making it difficult to house multiple nozzles compactly in a spout apparatus. Also in this type of spout apparatus, the problem is that a range to vary the spouting direction (amplitude of oscillation) cannot be changed. In this type of spout apparatus, attempting to change the amplitude requires mechanically changing the movable range over which the nozzle is driven, which creates the problem of an even more complicated mechanism around the nozzle. Also, in this type of spout apparatus the nozzle physically moves, therefore wear can easily occur in moving parts, resulting in the problem that the selection of materials for members comprising the movable portion is limited in order to avoid wear. An additional problem is that costs are increased because of the need to form movable parts with a complex structure from a wear-resistant material.

The type of spray apparatus set forth in Patent Documents 1 through 3, on the other hand, utilizes an oscillation phenomenon caused by a fluidic element; the spraying direction of a fluid can be changed without providing a movable member, thus yielding the advantage that the nozzle part can be compactly constituted by a simple structure.

However in the fluid element set forth in Patent Documents 1 and 2, the problem is that the amplitude of the reciprocating oscillation of sprayed hot or cold water cannot be changed. I.e., because the fluid element set forth in Patent Documents 1 and 2 takes advantage of the flow of sprayed fluid along wall surfaces due to the Coanda effect, the amplitude of sprayed hot or cold water is generally defined by the angle of the wall surfaces which the Coanda effect, and cannot be changed. I.e., for the Patent Document 1 fluid element, hot or cold water is fixed at an amplitude between state a and state c, and for the Patent Document 2 fluid element, it is fixed at an amplitude between the jet flow along the upper plate and the jet flow along the lower plate.

In contrast, the Patent Document 3 fluid element, while it does apply a Karman vortex, requires replacing parts in the outlet portion in order to change the amplitude or the like of sprayed hot or cold water, as shown in FIG. 10A-10C. Therefore a mechanical switching operation is required to change the amplitude, resulting in the problems of a more complicated faucet apparatus and greater difficulty in achieving a compact size.

The present invention therefore has the object of providing a spout apparatus which can be compactly constituted, and which is capable of changing the oscillation amplitude of jetted hot or cold water.

Means for Resolving Problems

In order to resolve the above-described problems, the present invention is a spout apparatus for discharging hot or cold water with reciprocal motion at a variable amplitude from a spouting port, comprising: a spout apparatus main body; and an oscillation inducing element disposed on the spout apparatus main body for discharging supplied hot or cold water with a reciprocal motion; wherein the oscillation inducing element comprises: a water supply passageway into which water supplied from the spout apparatus main body flows; a water collision portion disposed on a downstream end portion of the water supply passageway so as to block a portion of a cross-section of the water supply passageway, the water collision portion alternately produces oppositely circulating vortexes on the downstream side of the water collision portion by colliding with hot or cold water guided by the water supply passageway; a vortex street passageway disposed on a downstream side of the water supply passageway for guiding and growing the vortexes formed by the water collision portion; a discharge passageway disposed on a downstream side of the vortex street passageway for discharging hot or cold water guided by the vortex street passageway; a bypass passageway for causing hot or cold water supplied from the spout apparatus main body to flow into the vortex street passageway, detouring the water collision portion; and a flow volume ratio changing portion, capable of changing the flow volume ratio of hot or cold water flowing into the vortex street passageway through the water collision portion to hot or cold water flowing into the vortex street passageway through the bypass passageway.

In the invention thus constituted, hot or cold water supplied from the spout apparatus flows into the water supply passageway. The water collision portion is disposed on the downstream end portion of this water supply passageway so as to block a portion of the flow path cross section, and this water collision portion causes vortexes of alternately opposing circulations to be generated at the downstream side thereof by the collision of hot or cold water guided by the water supply passageway. Vortexes formed by the water collision portion are guided while be caused to grow by the vortex street passageway disposed on the downstream side of the water supply passageway. At the same time, hot or cold water flows into the vortex street passageway through the bypass passageway, detouring the water supply passageway. Hot or cold water guided by the vortex street passageway is discharged through a discharge passageway. The ratio between flow volumes of hot or cold water flowing into the vortex street passageway through the water collision portion and hot or cold water flowing into the vortex street passageway through the bypass passageway is changed by a flow volume ratio changing portion, and the amplitude of discharged hot or cold water is changed by changing this flow volume ratio. In other words, the oscillation inducing element is equipped with a vortex street passageway for guiding vortexes formed by the water collision portion while causing them to grow, and a bypass passageway for detouring the water collision portion and causing hot or cold water to flow into the vortex street passageway, and the amplitude of the oscillation is changed by suppressing the reciprocating oscillation of hot or cold water produced by vortexes using hot or cold water flowing in from the bypass passageway.

In the invention thus constituted, the oscillation amplitude of discharged hot or cold water can be changed using the ratio of hot or cold water from the water supply passageway flowing into the oscillation inducing element to hot or cold water from the bypass passageway, therefore the oscillation inducing element can change the amplitude of the reciprocating oscillation of discharged hot or cold water without requiring a mechanical movable part. A spout apparatus enabling the oscillation amplitude of jetted hot or cold water to be changed can thus be compactly constituted using a simple structure. Since the flow volume ratio changing portion changes the ratio of hot or cold water flowing in through the water collision portion to hot or cold water flowing in through the bypass passageway, the flow volume discharged from the spout apparatus is maintained essentially constant even if the oscillation amplitude is changed by the flow velocity ratio changing portion, therefore a conveniently usable spout apparatus, capable of changing the oscillation amplitude while maintaining a fixed flow volume, can be provided.

In the present invention, preferably, the flow volume ratio changing portion can be set in a range such that the flow velocity of hot or cold water flowing into the vortex street passageway through the water collision portion is faster than the flow velocity of hot or cold water flowing into the vortex street passageway through the bypass passageway.

In the invention thus constituted, the flow velocity of hot or cold water flowing in from the bypass passageway is slowed, therefore vortexes produced by the water collision portion are not excessively extinguished, and by increasing the hot or cold water flowing in from the bypass passageway the oscillation amplitude can be gradually reduced, and the oscillation amplitude can be adjusted over a wide range.

In the present invention, preferably, the water collision portion is disposed to extend to traverse between a pair of opposing wall surfaces in the water supply passageway, and the bypass passageway allows the inflow of hot or cold water in a direction perpendicular to the direction in which the water collision portion extends.

In the invention thus constituted, the bypass passageway causes an inflow of hot or cold water in a direction perpendicular to the direction in which the water collision portion extends, therefore hot or cold water flows in through the bypass passageway from the side formed at the downstream side of the water collision portion relative to the vortex street. Vortex flows can thus be weakened without excessively destroying the formed vortexes; the oscillation amplitude can be gradually reduced, and can be adjusted over a broad range.

In the present invention, preferably, the bypass passageway allows the inflow of substantially the same amount of hot or cold water from both sides of the vortex street passageway.

In the invention thus constituted, substantially the same flow volume of hot or cold water from the bypass passageway 6*b* flows in from both sides of the vortex street passageway, therefore no major biasing occurs in the flow within the vortex street passageway, and biasing of the reciprocating oscillation of hot or cold water can be reduced.

In the present invention, preferably, two bypass inflow ports for allowing hot or cold water to flow in from the bypass passageway to the vortex street passageway are disposed on the vortex street passageway in mutual opposition.

In the invention thus constituted, two bypass inflow ports are disposed to be mutually opposing, therefore the flow in the vortex street passageway can be kept substantially symmetrical, and the reciprocating oscillation of discharged hot or cold water can be substantially symmetrically reduced.

Effect of the Invention

Using the present invention, a spout apparatus enabling the oscillation amplitude of jetted hot or cold water to be changed can thus be compactly constituted using a simple structure.

EMBODIMENTS

Next, referring to the attached figures, we explain a shower head serving as a spout apparatus in a preferred embodiment of the invention.

Figure 1:
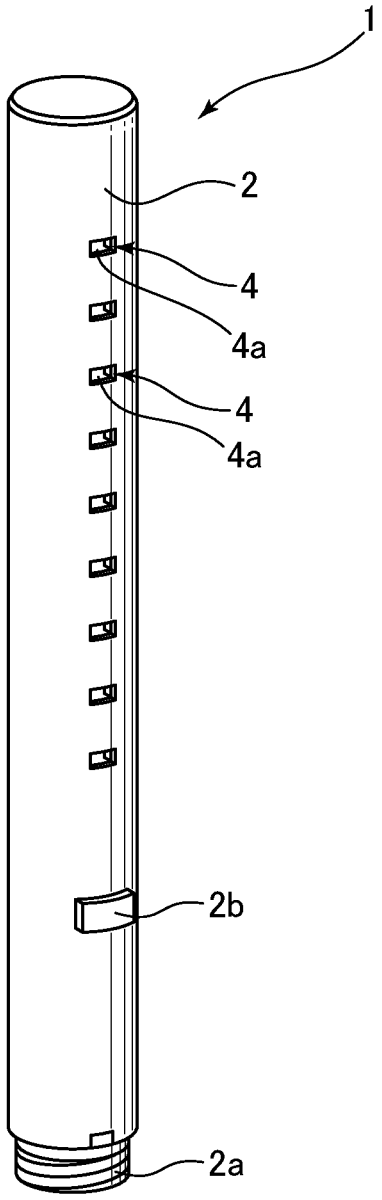
FIG. 1: A perspective view showing the external appearance of a shower head according to an embodiment of the present invention.
Figure 2:
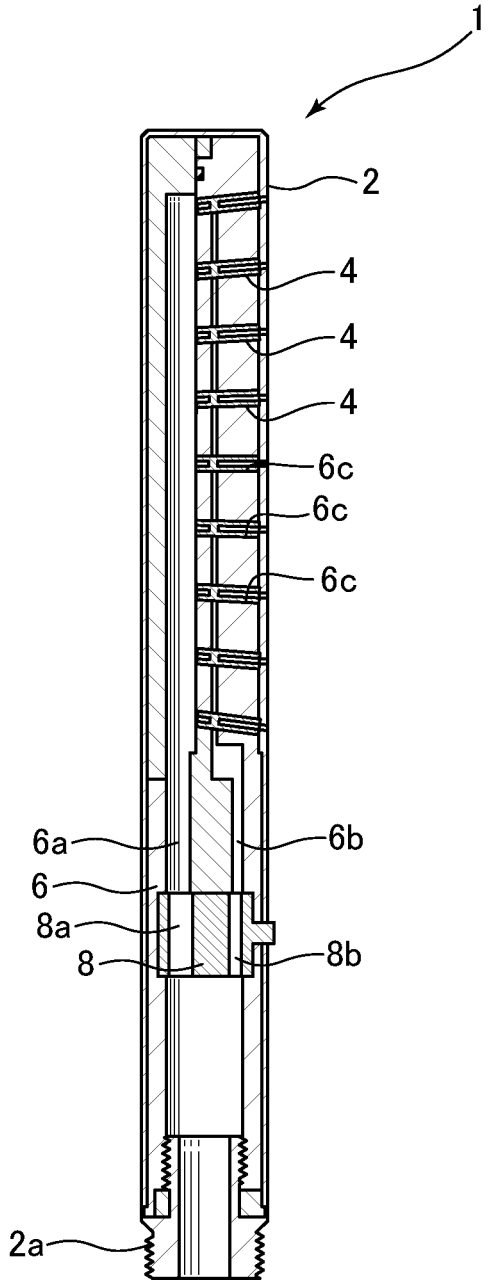
FIG. 2: An full cross section of a shower head according to an embodiment of the present invention.
Figure 3:
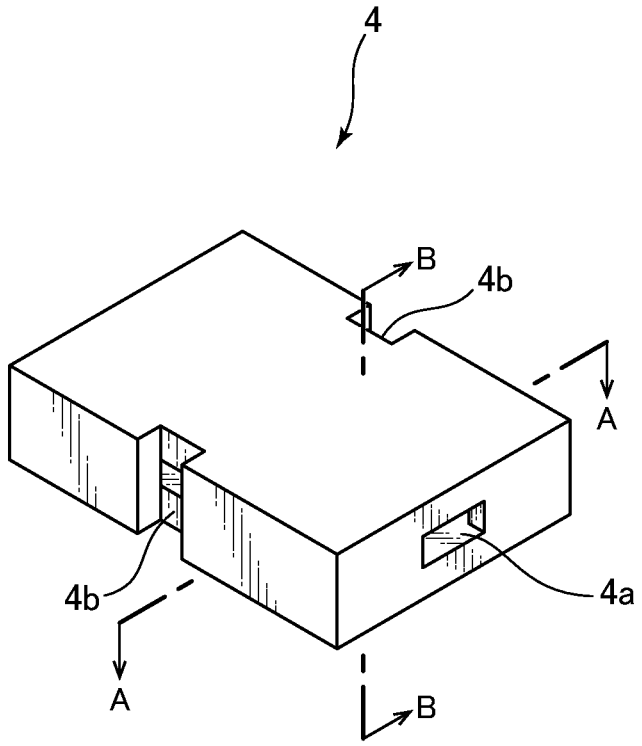
FIG. 3: A perspective view showing the external appearance of an oscillation inducing element provided in a shower head according to an embodiment of the present invention.

First, referring to FIGS. 1 through 8, we explain a shower head according to an embodiment of the present invention. FIG. 1 is a perspective view showing the external appearance of a shower head according to an embodiment of the present invention. FIG. 2 is an overall cross section of a shower head according to an embodiment of the present invention. FIG. 3 is a perspective view showing the external appearance of an oscillation inducing element provided in a shower head according to an embodiment of the present invention. FIG. 4A is a plan view cross section of an oscillation inducing element in a first embodiment of the invention. FIG. 4B is a vertical cross section of an oscillation inducing element.

As shown in FIG. 1, the shower head 1 of the present embodiment has: a shower head main body 2, being an approximately cylindrical spout apparatus, nine oscillation inducing elements 4, arrayed and embedded in a straight line in the axial direction inside the shower head main body 2, and an amplitude changing knob 2*b* for changing the oscillation amplitude of discharged hot or cold water.

When hot or cold water is supplied from a shower hose (not shown) connected to the shower head main body 2 base end portion 2*a*, the shower head 1 of the present embodiment discharges hot or cold water from the spout water ports 4*a* on each oscillation inducing element 4. The amplitude at which hot or cold water reciprocally oscillates can be changed by manipulating the amplitude changing knob 2*b*. Note that in the present embodiment the hot or cold water is discharged from each spout port 4*a* so as to form a fan shape in a plane approximately perpendicular to the center axis line of the shower head main body 2, and the center angle of the fan shape can be changed by the amplitude changing knob 2*b*.

Next, referring to FIG. 2, we explain the internal structure of the shower head 1.

As shown in FIG. 2, built into the shower head main body 2 are: a conduit-forming member 6 for forming the water conduit and for holding each of the oscillation inducing elements 4, and a flow volume ratio adjusting member 8, disposed at the base end portion of this conduit-forming member 6 and serving as a flow volume ratio changing portion.

The water conduit-forming member 6 is a generally cylindrical member, and is constituted to form a flow path for hot or cold water supplied into the shower head main body 2. A shower hose (not shown) is connected in a watertight manner to the base end portion of the water conduit-forming member 6. A main water conduit 6*a* extending in generally the axial direction, and a bypass passageway 6*b* extending generally parallel to this main water conduit 6*a*, are formed on the interior of the conduit-forming member 6.

Moreover, nine element insertion holes 6*c* for the insertion and holding of each of the oscillation inducing elements 4 are formed in the conduit-forming member 6 so as to communicate with the main water conduit 6*a* and the bypass passageway 6*b*. Each of the element insertion holes 6*c* is formed to cross the bypass passageway 6*b* from the outer circumferential surface of the conduit-forming member 6 and extend up to the main water conduit 6*a*. The element insertion holes 6*c* are formed at generally equal intervals in a straight line in the axial direction. Hot or cold water flowing into the conduit-forming member 6 main water conduit 6*a* thus flows in from the rear surface side of the oscillation inducing elements 4 being held on the conduit-forming member 6, and is discharged from a spout port 4*a* disposed on the front surface thereof. Hot or cold water flowing into the conduit-forming member 6 bypass passageway 6*b*, on the other hand, flows in from both side surface of each of the oscillation inducing elements 4, and is discharged from the spout port 4*a*.

Each element insertion hole 6*c* is placed so as to tilt slightly relative to a plane perpendicular to the center axis line of the shower head main body 2, and hot or cold water sprayed from each oscillation inducing element 4 is discharged overall so as to spread out slightly in the axial direction of the shower head main body 2.

The flow volume ratio adjusting member 8 is a generally round columnar member, and is attached to the base portion of the conduit-forming member 6 so as to be able to rotate about the center axis line thereof. This flow volume ratio adjusting member 8 is constituted to be rotated by user manipulation of the amplitude changing knob 2*b* (FIG. 1). A main water conducting bore 8*a* and bypass water conducting bore 8*b* extending in the axial direction are formed in the flow volume ratio adjusting member 8, and are respectively positioned to communicate with the main water conduit 6*a* and the bypass passageway 6*b*. Hot or cold water flowing into the shower head main body 2 flows through the main water conducting bore 8*a* into the main water conduit 6*a*, then flows into the bypass passageway 6*b* through the bypass water conducting bore 8*b*. Rotation of the flow volume ratio adjusting member 8 results in a change in the degree of fit between the main water conduit 6*a* and the main water conducting bore 8*a*, and between the bypass passageway 6*b* and the bypass water conducting bore 8*b*, thereby changing the proportion of hot or cold water respectively flowing into the main water conduit 6*a* and the bypass passageway 6*b*. Note also that the total volume of hot or cold water flowing into the main water conduit 6*a* and the bypass passageway 6*b* barely changes with manipulation of the flow volume ratio adjusting member 8, and the total volume of discharged hot or cold water is essentially fixed, regardless of the rotational position of the flow volume ratio adjusting member 8.

Figure 4A:
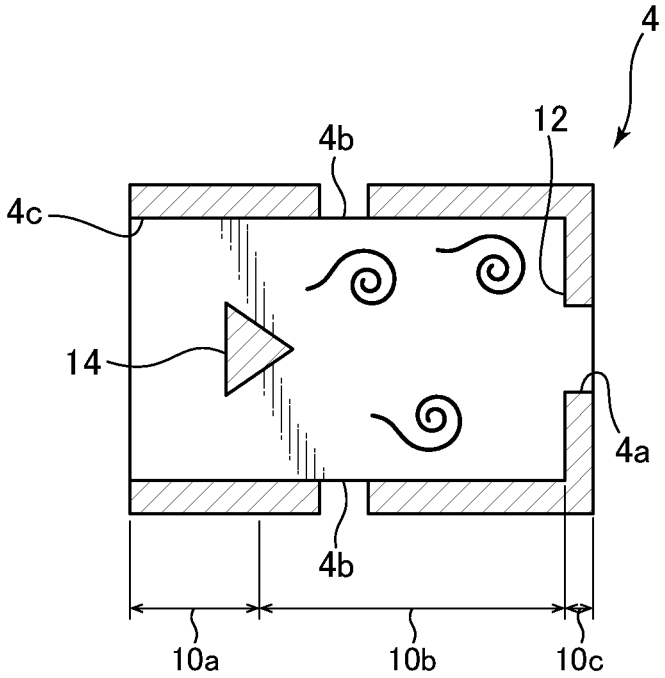
FIG. 4A: A plan view cross section of an oscillation inducing element in an embodiment of the invention.
Figure 4B:
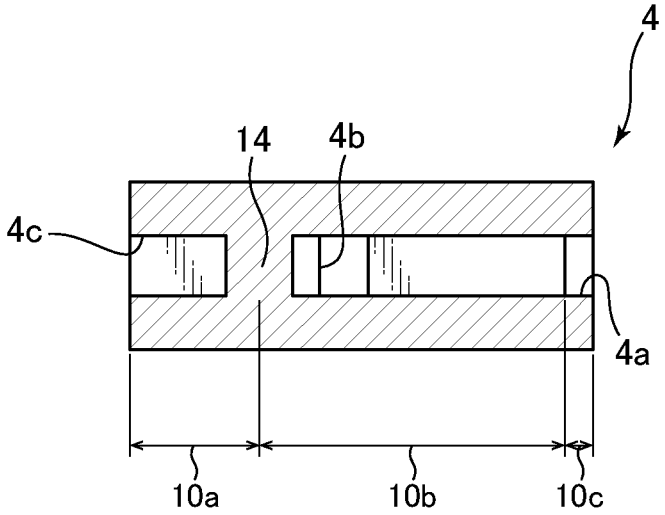
FIG. 4B: A vertical cross section of an oscillation inducing element.

Next, referring to FIGS. 3 and 4A-4B, we explain the constitution of an oscillation inducing element 4 built into the shower head of the present embodiment.

As shown in FIG. 3, the oscillation inducing elements 4 are generally thin rectangular members; a rectangular spout port 4*a* is disposed on the end surface of the front sides thereof; bypass inflow ports 4*b* are disposed on both side surfaces, and a main flow inlet 4*c* is formed on the end surface of the rear surface side (FIG. 4A-4B). When each of the oscillation inducing elements 4 is inserted into an element insertion hole 6*c*, the main flow inlet 4*c* communicates with the conduit-forming member 6 main water conduit 6*a*, and bypass inflow port 4*b* communicates with the bypass passageway 6*b*.

FIG. 4A is a cross section seen along line A-A in FIG. 3; FIG. 4B is a cross sectional diagram along line B-B in FIG. 3.

As shown in FIG. 4B, a passageway with a rectangular cross section is formed on the inside of the oscillation inducing element 4 so as to penetrate in the longitudinal direction. This passageway is formed, in order from the upstream side, by the inlet portion water supply passageway 10*a*, the vortex street passageway 10*b*, and the discharge passageway 10*c*.

The water supply passageway 10*a* is a straight passageway with an essentially constant rectangular cross section, extending from the inflow port 4*c* on the rear surface side of the oscillation inducing element 4.

The vortex street passageway 10*b* is a rectangular cross section passageway disposed on the downstream side of the water supply passageway 10*a*, contiguous with the water supply passageway 10*a*. I.e., in the present embodiment the water supply passageway 10*a* and the vortex street passageway 10*b* extend in a straight line with the same cross sectional shapes. Also, bypass inflow ports 4*b* are respectively disposed to face one another on the side surface at both sides of the vortex street passageway 10*b*. Hot or cold water guided by the bypass passageway 6*b* flows into the vortex street passageway 10*b* through each of the bypass inflow ports 4*b*.

A discharge passageway 10*c* is a passageway with a rectangular fixed cross section, disposed on the downstream side so as to communicate with the vortex street passageway 10*b*; in substance it has only the length of the wall thickness of the oscillation inducing elements 4. This discharge passageway 10*c* is smaller than the flow path cross sectional area of the vortex street passageway 10*b*, so that hot or cold water guided by the vortex street passageway 10*b* containing vortex streets is constricted, then discharged by the spout port 4*a*. Therefore a stepped portion 12 is formed between the vortex street passageway 10*b* and the discharge passageway 10*c*.

Also, as shown in FIG. 4B, the wall surfaces (ceiling surface and floor surface) opposing one another in the height direction of the water supply passageway 10*a*, the vortex street passageway 10*b*, and the discharge passageway 10*c* are all disposed on the same plane. I.e., the heights of the water supply passageway 10*a*, vortex street passageway 10*b*, and discharge passageway 10*c* are all the same, and are fixed.

In addition, a water collision portion 14 is formed on the downstream end portion of the water supply passageway 10*a* (close to the connecting portion between water supply passageway 10*a* and vortex street passageway 10*b*), and this water collision portion 14 is placed so as to block a portion of the flow path cross section of the water supply passageway 10*a*. This water collision portion 14 is a triangular columnar part extending so as to link to opposing wall surfaces (ceiling surface and floor surface) in the height direction of the water supply passageway 10*a*, and is disposed in an island shape at the center in the width direction of the water supply passageway 10*a*. The cross section of the water collision portion 14 is formed in an isosceles right triangle shape; the hypotenuse thereof is disposed to be perpendicular to the center axis line of the water supply passageway 10*a*, and the right angle part of the isosceles right triangle is disposed to face downstream. Placement of this water collision portion 14 produces a Karman vortex on the downstream side thereof, causing hot or cold water discharged from the spouting port 4*a* to oscillate in reciprocal motion. As described above, bypass inflow ports 4*b* are placed in mutual opposition on both sides of the vortex street passageway 10*b*, and hot or cold water which has passed through the bypass passageway 6*b* from the bypass inflow ports 4*b* flows into same, therefore the bypass passageway 6*b* allows the flow of hot or cold water into the vortex street passageway 10*b* in a direction perpendicular to the direction in which the water collision portion 14 extends.

Note that in the present embodiment the flow path cross sectional area (the surface area of the flow path cross sectional area of the water supply passageway 10*a* minus the projected surface area of the water collision portion 14) is constituted to be larger than the flow path surface area of the discharge passageway 10*c*.

Next, referring to FIGS. 5 through 8, we explain the operation of a shower head 1 according to a first embodiment of the invention.

Figure 5:
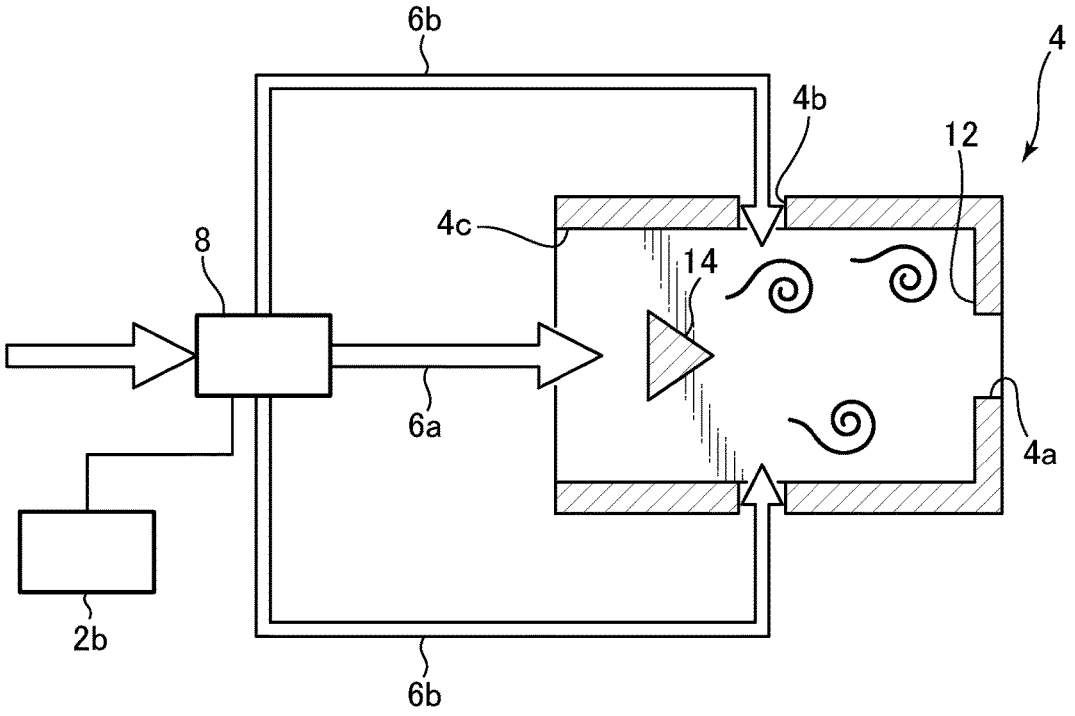
FIG. 5: A block diagram showing the flow of hot or cold water in a shower head according to an embodiment of the present invention.
Figure 6:
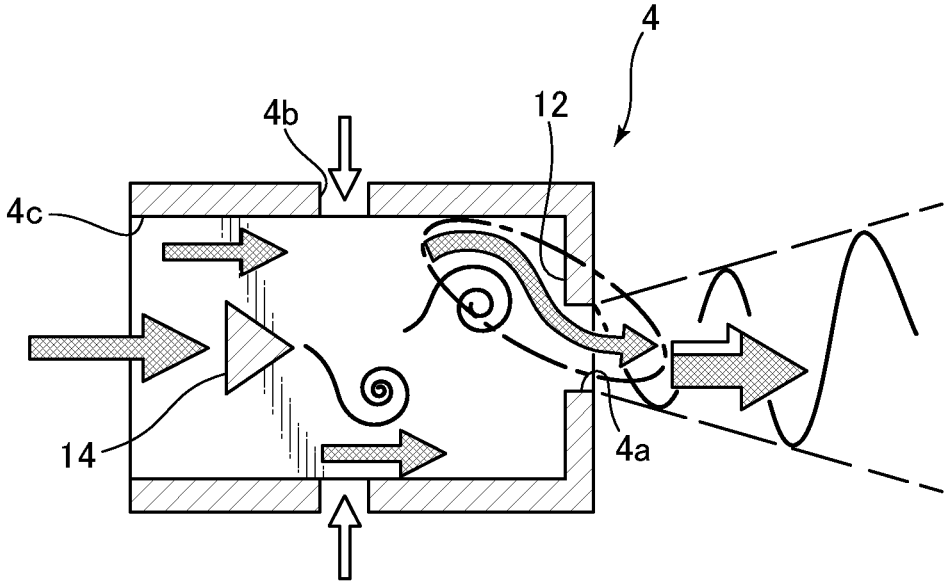
FIG. 6: A diagram showing water spouting in an oscillation inducing element provided in an embodiment of the present invention when the ratio between hot or cold water flowing in from a main flow inlet to total hot or cold water flowing in from each bypass inflow port is 9:1.
Figure 7:
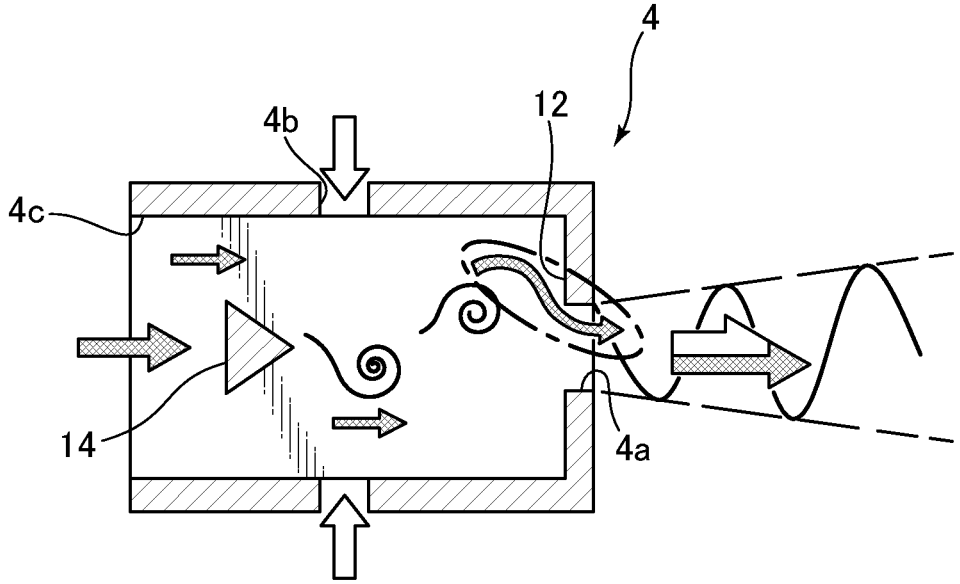
FIG. 7: A diagram showing water spouting in an oscillation inducing element provided in an embodiment of the present invention when the ratio between hot or cold water flowing in from a main flow inlet to total hot or cold water flowing in from each bypass inflow port is 6:4.
Figure 8:
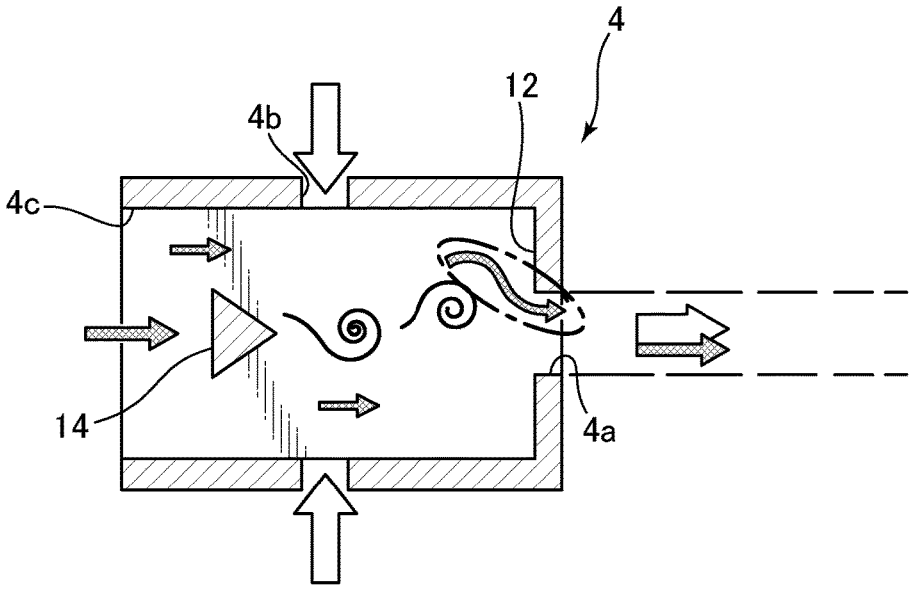
FIG. 8: A diagram showing water spouting in an oscillation inducing element provided in an embodiment of the present invention when the ratio between hot or cold water flowing in from a main flow inlet to total hot or cold water flowing in from each bypass inflow port is 5:5.
Figure 9:
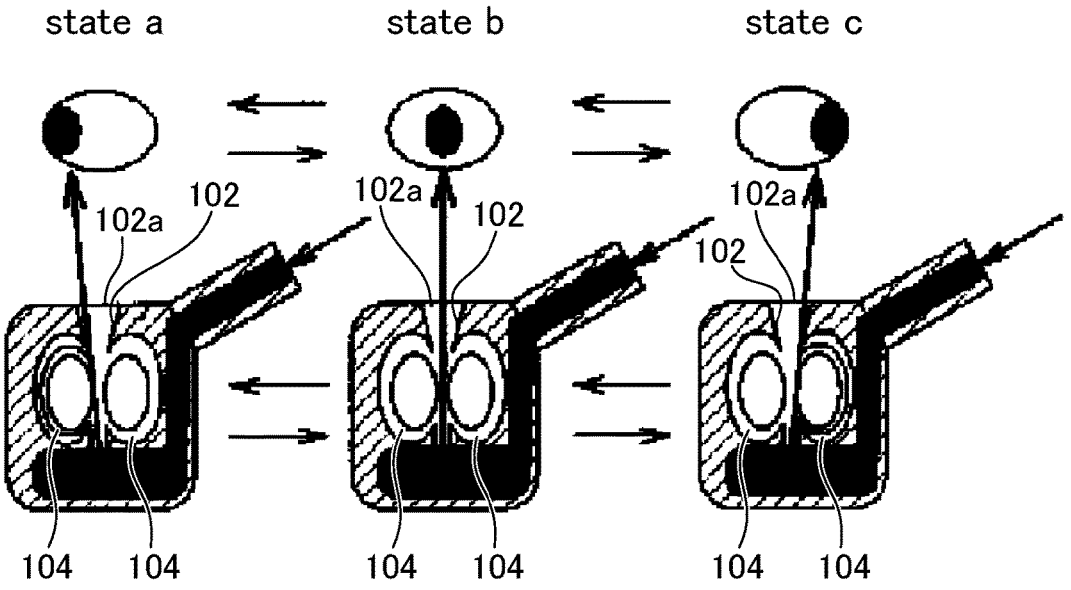
FIG. 9: A diagram showing the operation of the fluid element set forth in Patent Document 1.
Figure 10A:
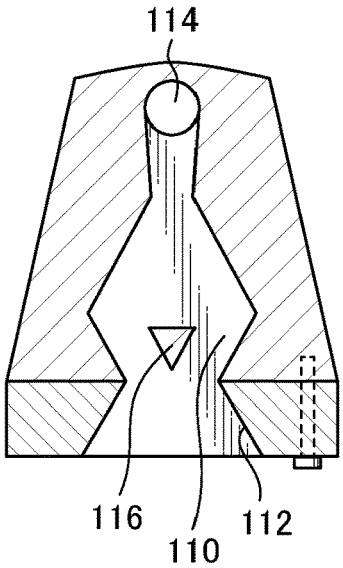
FIG. 10A-10C: A diagram showing the constitution of the fluid element set forth in Patent Document 3.
Figure 10B:
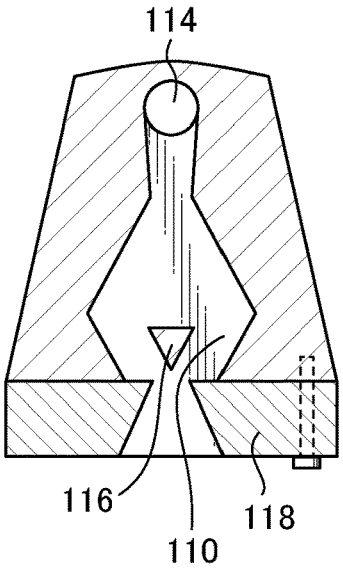
Prior Art FIG.10B
Figure 10C:
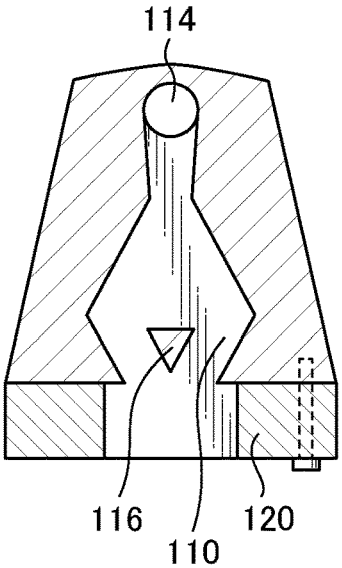
Prior Art FIG.10C

FIG. 5 is a block diagram showing the flow of hot or cold water in a shower head 1 according to an embodiment of the present invention. FIGS. 6 through 8 schematically explain the relationship of the flow volumes of hot or cold water respectively flowing in from the main flow inlet 4*c* and bypass inflow ports 4*b* to oscillation amplitude.

As shown in FIG. 5, hot or cold water supplied from a shower hose (not shown) flows into a conduit-forming member 6 (FIG. 2) inside the shower head main body 2, reaching the flow volume ratio adjusting member 8. Hot or cold water which has reached the flow volume ratio adjusting member 8 respectively flows into the main water conducting bore 8*a* and the bypass water conducting bore 8*b* at a predetermined ratio according to the rotational position of the flow volume ratio adjusting member 8. Hot or cold water flowing in from the main water conducting bore 8*a* passes through the conduit-forming member 6 main water conduit 6*a*, and flows into the oscillation inducing element 4 from the main flow inlet 4*c* in oscillation inducing element 4. On the other hand hot or cold water flowing into the bypass water conducting bore 8*b* passes through the bypass passageway 6*b* in the conduit-forming member 6 and reaches each oscillation inducing element 4; it is then branched into two parts and flows into the oscillation inducing element 4 at essentially the same flow volume from the bypass inflow ports 4*b* on both sides. Therefore the flow volume ratio adjusting member 8 is constituted to enable the ratio to be varied between the flow volumes of hot or cold water flowing into the vortex street passageway 10*b* through the water collision portion 14 from the main flow inlet 4*c* on the oscillation inducing element 4 and hot or cold water flowing into the vortex street passageway 10*b* through the bypass passageway 6*b*.

Hot or cold water flowing into the water supply passageway 10*a* from the main flow inlet 4*c* in the oscillation inducing element 4 collides with the water collision portion 14, which is disposed to block a portion of that flow path. Karman vortex streets of alternately opposite circulations are thus formed on both the left and right sides of the water collision portion 14 on the downstream side of the water collision portion 14. Karman vortexes formed by this water collision portion 14 grow as they are guided by the vortex street passageway 10*b*, and reach the discharge passageway 10*c*.

Vortexes are produced on the downstream side of the water collision portion 14, and flow velocity increases in that part. This high flow velocity part (the dense colored part in FIG. 5) alternately appears on both sides of the water collision portion 14 and advances along the wall surface of the vortex street passageway 10*b* toward the spouting port 4*a*. Hot or cold water reaching the end portion of the vortex street passageway 10*b* collides with the stepped portion 12, and the direction of discharge is bent based on the flow velocity distribution in the spout port 4*a*. I.e., when the high flow velocity part of the hot or cold water is located at the top end of the spouting port 4*a* in FIG. 5, hot or cold water is sprayed downward; when the high flow velocity part thereof is positioned at the bottom end of the spouting port 4*a*, hot or cold water is sprayed upward. Thus by alternately generating Karman vortexes at the downstream side of the water collision portion 14, a flow velocity distribution is produced in the spout port 4*a*, and the jet flow is deflected. Because the position of the high flow velocity part moves reciprocally with the advance of the vortex street, sprayed hot or cold water also oscillates reciprocally.

In addition to hot or cold water flowing in from such a main flow inlet 4*c*, hot or cold water also flows into the oscillation inducing element 4 from the bypass inflow ports 4*b* on both sides. Each bypass inflow port 4*b* is placed in the middle of the vortex street passageway 10*b*, further downstream than the water collision portion 14, so hot or cold water from each bypass inflow port 4*b* merges from the side with the flow that includes Karman vortexes formed by the water collision portion 14. I.e., hot or cold water flowing in from each of the bypass inflow ports 4*b* through the bypass passageway 6*b* detours the water collision portion 14 and flows into the vortex street passageway 10*b*. Note that in the present embodiment the flow velocity of hot or cold water flowing in from the bypass inflow ports 4*b* through the bypass inflow ports 4*b* is constituted to always be slower than the flow velocity of hot or cold water flowing into the vortex street passageway 10*b* through the water collision portion 14, regardless of the flow volume ratio adjusting member 8 setting.

Next, referring to FIGS. 6 through 8, we explain the action of hot or cold water flowing in from the bypass inflow ports 4*b*.

FIG. 6 is a diagram showing water spouting when the ratio between hot or cold water flowing in from a main flow inlet 4*c* to total hot or cold water flowing in from each bypass inflow port is 9:1.

In this case the majority of the hot or cold water flows in from the main flow inlet 4*c*, and since vortex streets in which strong Karman vortexes are formed by the water collision portion 14 reach the spout port 4*a*, the flow velocity in the spout port 4*a* changes greatly due to the advance of the vortex streets, and discharged hot or cold water is significantly deflected. Thus sprayed hot or cold water oscillates in a reciprocal motion at a high amplitude.

Next, FIG. 7 is a diagram showing water spouting when the ratio between hot or cold water flowing in from a main flow inlet 4*c* to total hot or cold water flowing in from each bypass inflow port is 6:4.

In this case the hot or cold water flowing in from the main flow inlet 4*c* diminishes, therefore the Karman vortexes formed by the water collision portion 14 are weakened. In addition, because hot or cold water not forming vortex flows from each bypass inflow port 4*b* merges inside the vortex street passageway 10*b*, changes in the flow velocity in the spout port 4*a* associated with the progress of the vortex street diminish, and discharged hot or cold water is no longer significantly deflected. The oscillation amplitude of sprayed hot or cold water is by this means reduced. However even when the ratio of the flow volume from the main flow inlet 4*c* to the flow volume from each bypass inflow port 4*b* is changed by manipulation of the flow volume ratio adjusting member 8, the total of these flow volumes does not change, therefore the total amount of discharged hot or cold water is essentially the same as in the FIG. 6 case.

Next, FIG. 8 is a diagram showing water spouting when the ratio between hot or cold water flowing in from a main flow inlet 4*c* to total hot or cold water flowing in from each bypass inflow port is 5:5.

In this case the hot or cold water flowing in from the main flow inlet 4*c* diminishes, therefore Karman vortexes formed by the water collision portion 14 are further weakened. In addition, because of the increase in hot or cold water from each of the bypass inflow ports 4*b*, which does not form vortex flows, there are virtually no changes in the flow velocity at the spout port 4*a* associated with advance of a vortex street, and discharged hot or cold water advances directly, without oscillating. In this case as well, because the total flow volume at the main flow inlet 4*c* and at each bypass inflow port 4*b* is not changing, the total volume of discharged hot or cold water is essentially the same as shown in FIG. 6.

Thus by manipulating the amplitude changing knob 2*b*, a user can change just the hot or cold water discharge area without changing the discharge flow volume, therefore a shower head with good usability can be obtained, capable of easily conforming to preferences or usage conditions.

In the shower head 1 in an embodiment of the present invention, the oscillation amplitude of discharged hot or cold water can be changed using the ratio of hot or cold water from the water supply passageway 10*a* flowing into the oscillation inducing element 4 to hot or cold water from the bypass passageway 6*b*, therefore the oscillation inducing element 4 can change the amplitude of the reciprocating oscillation of discharged hot or cold water without comprising mechanical movable parts. A shower head 1 enabling the oscillation amplitude of jetted hot or cold water to be changed can thus be compactly constituted using a simple structure. Because the flow volume ratio adjusting member 8 changes the ratio between hot or cold water flowing in through the water collision portion 14 to hot or cold water flowing in through the bypass passageway 6*b*, the flow volume discharged from the shower head 1 is maintained at essentially a constant level even if the oscillation amplitude is changed by the flow volume ratio adjusting member 8, thus providing an easily usable shower head 1 with which the oscillation amplitude can be changed while holding flow volume constant.

Using the shower head 1 of the present embodiment, the flow velocity of hot or cold water flowing in from the bypass passageway is slowed, therefore vortexes produced by the water collision portion 14 are not excessively extinguished, and by increasing the hot or cold water flowing in from the bypass passageway 6*b*, the oscillation amplitude can be gradually reduced and adjusted over a wide range.

Furthermore, using the shower head 1 of the present embodiment the bypass passageway 6*b* allows hot or cold water to flow in from a direction perpendicular to the direction in which the water collision portion 14 extends, therefore for vortex streets formed on the downstream side of the water collision portion 14, hot or cold water passes through the bypass passageway 6*b* and flows in from the side. Vortex flows can thus be weakened without excessively destroying the formed vortexes; the oscillation amplitude can be gradually reduced, and can be adjusted over a broad range.

In the shower head 1 of the present embodiment, essentially the same flow volume of hot or cold water from the bypass passageway 6*b* flows in from both sides of the vortex street passageway, therefore no major biasing occurs in the flow within the vortex street passageway, and biasing of the reciprocating oscillation of hot or cold water can be reduced.

Moreover, by using the shower head 1 of the present embodiment, two bypass inflow ports 4*b* are disposed in mutually opposition, therefore the flow in the vortex street passageway 10*b* can be kept essentially symmetrical, and the reciprocating oscillation of discharged hot or cold water can be essentially symmetrically reduced.

We have described above a preferred embodiment of the present invention, but various changes may be applied to the above-described embodiments. In particular, in the above-described embodiment the invention was applied to a shower head, but the invention may also be applied to any desired spout apparatus, such as a faucet apparatus used in a kitchen sink or washbasin, or a warm water flush apparatus installed on a toilet seat, or the like. In the above-described present embodiment, multiple oscillation inducing elements were provided in a shower head, but any desired number of oscillation inducing elements may be provided in the spout apparatus according to use, and a spout apparatus comprising a single oscillation inducing element may also be constituted.

In the above-described embodiment of the invention we explained the shape of the oscillation inducing element passageway with terms such as "width" and "height" for convenience, but these terms do not define the direction in which the oscillation inducing element is disposed; the oscillation inducing element may be oriented in any desired direction. For example, an oscillation inducing element may also be used by orienting the "height" in the above-described embodiment in the horizontal direction.

EXPLANATION OF REFERENCE NUMERALS

1: A shower head, being the spout apparatus of the first embodiment of the invention.
2: shower head main body (spout apparatus main body)
2*a*: base end portion
2*b*: amplitude changing knob
4: oscillation inducing element
4*a*: spout port
4*b*: bypass inflow ports
4*c*: main flow inlet
6: conduit-forming member
6*a*: main water conduit
6*b*: bypass passageway
6*c*: element insertion holes
8: flow volume ratio adjusting member (flow volume ratio changing portion)
8*a*: main water conducting bore
8*b*: bypass water conducting bore
10*a*: water supply passageway
10*b*: vortex street passageway
10*c*: discharge passageway
12: stepped portion
14: water collision portion
102: spray nozzle
102*a*: spray port
104: feedback flow path
110: anterior chamber

112: outlet
114: intake port
116: obstacle
118: replacement part
120: replacement part

The invention claimed is:

1. A spout apparatus for discharging water with reciprocal motion at a variable amplitude from a spouting port, comprising:

a spout apparatus main body;

an oscillation inducing element disposed on the spout apparatus main body for discharging supplied water with a reciprocal motion; and a valve disposed in the spout apparatus main body, wherein the oscillation inducing element comprises:

a water supply passageway into which water supplied from the spout apparatus main body flows;

a water collision portion positioned on a central axis of the water supply passageway and disposed on a downstream end portion of the water supply passageway in an island shape so as to block an intermediate portion of a cross-section of the water supply passageway, the water collision portion alternately produces oppositely circulating Karman vortexes on a downstream side of the water collision portion by colliding with water guided by the water supply passageway;

a vortex street passageway disposed on a downstream side of the water supply passageway for guiding and growing the vortexes formed by the water collision portion;

a discharge passageway disposed on a downstream side of the vortex street passageway for discharging water guided by the vortex street passageway; and a bypass passageway for causing water supplied from the spout apparatus main body to flow into the downstream side of the water collision portion in the vortex street passageway, detouring the water collision portion, wherein the valve (i) divides inflow water to the spout apparatus main body into the water flowing into the water supply passageway and the water flowing into the bypass passageway and (ii) changes a flow volume ratio of water flowing into the vortex street passageway through the water collision portion to water flowing into the vortex street passageway through the bypass passageway.

2. A spout apparatus for discharging water with reciprocal motion at a variable amplitude from a spouting port, comprising:

a spout apparatus main body;

an oscillation inducing element disposed on the spout apparatus main body for discharging supplied water with a reciprocal motion, and a valve disposed in the spout apparatus main body, wherein the oscillation inducing element comprises:

a water supply passageway into which water supplied from the spout apparatus main body flows;

a water collision portion positioned on a central axis of the water supply passageway and disposed on a downstream end portion of the water supply passageway in an island shape so as to block an intermediate portion of a cross-section of the water supply passageway, the water collision portion alternately produces oppositely circulating Karman vortexes on a downstream side of the water collision portion by colliding with water guided by the water supply passageway;

a vortex street passageway disposed on a downstream side of the water supply passageway for guiding and growing the vortexes formed by the water collision portion;

a discharge passageway disposed on a downstream side of the vortex street passageway for discharging water guided by the vortex street passageway; and a bypass passageway for causing water supplied from the spout apparatus main body to flow into the downstream side of the water collision portion in the vortex street passageway, detouring the water collision portion;

wherein the valve (i) divides inflow water to the spout apparatus main body into the water flowing into the water supply passageway and the water flowing into the bypass passageway and (ii) changes a flow volume ratio of water flowing into the vortex street passageway through the water collision portion to water flowing into the vortex street passageway through the bypass passageway, wherein a flow velocity of water flowing into the vortex street passageway through the water collision portion is faster than a flow velocity of water flowing into the vortex street passageway through the bypass passageway.

3. The spout apparatus of claim 2, wherein the water collision portion is disposed to extend to traverse between a pair of opposing wall surfaces in the water supply passageway, and the bypass passageway allows the inflow of water in a direction perpendicular to the direction in which the water collision portion extends.

4. The spout apparatus of claim 3, wherein the bypass passageway allows the inflow in a direction within a plane on which the water discharged from the oscillation inducing element is reciprocated.

5. The spout apparatus of claim 2, wherein the bypass passageway allows the inflow of substantially the same amount of water from both sides of the vortex street passageway.

6. The spout apparatus of claim 5, wherein the valve is configured to supply water through bypass inflow ports into the vortex street passage, and water flowing through the bypass inflow ports have always substantially the same flow rates.

7. The spout apparatus of claim 2, wherein two bypass inflow ports for allowing water to flow in from the bypass passageway to the vortex street passageway are disposed on the vortex street passageway in mutual opposition.

8. The spout apparatus of claim 7, wherein the inflow ports are mutually opposed so as to make the opposing inflows from the inflow ports.

* * * * *